US008704699B2

(12) United States Patent
Geswender

(10) Patent No.: US 8,704,699 B2
(45) Date of Patent: Apr. 22, 2014

(54) DIPOLE BASED DECOY SYSTEM

(75) Inventor: Chris E. Geswender, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 3074 days.

(21) Appl. No.: 10/706,665

(22) Filed: Nov. 12, 2003

(65) Prior Publication Data

US 2014/0009319 A1 Jan. 9, 2014

(51) Int. Cl.
*H01Q 15/00* (2006.01)

(52) U.S. Cl.
USPC ..... 342/9

(58) Field of Classification Search
USPC ..... 342/5–12
See application file for complete search history.

(56) References Cited

U.S. PATENT DOCUMENTS 3,715,754 A * 2/1973 Parry ..... 342/12
3,780,662 A * 12/1973 Sorenson ..... 342/12
3,910,189 A * 10/1975 Whidden et al. ..... 342/12
4,149,166 A * 4/1979 Null ..... 342/13
4,653,379 A * 3/1987 Barret et al. ..... 89/1.34
4,763,127 A * 8/1988 Sallee ..... 342/12
4,890,109 A 12/1989 Gagliardi
5,087,515 A 2/1992 Stevens et al.
5,260,820 A * 11/1993 Bull et al. ..... 398/125
5,352,519 A 10/1994 Stevens et al.
5,773,745 A 6/1998 Widmer
5,900,831 A 5/1999 Eisle et al.
6,513,438 B1 2/2003 Fegg et al.
7,847,721 B1 * 12/2010 Carlsson et al. ..... 342/6

* cited by examiner

*Primary Examiner* — Timothy A Brainard
(74) *Attorney, Agent, or Firm* — Donald F. Mofford, Esq.

(57) ABSTRACT

A dipole based decoy system provides an inexpensive alternative to chaff. A non-conductive filament patterned with lengths of conductive material that form dipole antennas at one or more radar frequencies is stored on the air vehicle and attached to a projectile. In response to a RWR warning, a programmed time or location or a time-to-target, a mechanism releases the projectile(s) to deploy the filament with its dipole antennas at a speed greater than or equal to the speed of the air vehicle to present an extended target or a separate false target to enemy radar. The projectile is either towed behind the air vehicle or launched away from the air vehicle. Either approach is effective to overcome Doppler and moving range gating by presenting coherent signal returns and ranges and velocities consistent with the air vehicle during a threat interval posed by the radar defense systems.

29 Claims, 7 Drawing Sheets

DIPOLE BASED DECOY SYSTEM

BACKGROUND OF THE INVENTION

1. Field of the Invention

This invention relates to dipole based decoy systems for protecting air vehicles against radar directed weapons and terminal defense systems.

2. Description of the Related Art

Air vehicles including fighter jets, unmanned drones, strategic and tactical missiles and artillery shells are susceptible to engagement by radar directed weapons such as guns, surface-to-air missiles (SAMS) or terminal reactively launched explosives. These defensive weapons systems pose a serious danger to pilots, survivability of the offensive weapons and the efficacy of the mission. As radar defenses become more sophisticated to engage and defeat traditional countermeasures, the air vehicle anti-defense systems must adapt.

During World War II, it was discovered that radar could be confused by the use of strips of aluminum cut into lengths representing the half wavelength of the radar frequency threatening the air vehicle, e.g. a "dipole". This invention was called "CHAFF" and is still used extensively by all air forces in combat. More recent developments in chaff technology include the use of aluminum-coated glass filament and silver-coated nylon filament.

Tens to hundreds of thousands of these strips may be packaged into a dispenser and dispersed as necessary to present false target information to confuse the enemy. Chaff is typically packaged in units about twice the size of a cigarette pack. When individual fibers of such a unit are widely dispersed in the atmosphere they create a radar echo similar to that of a small air vehicle or missile. If a stronger echo is wanted, one dispenses two or three units simultaneously.

The effects produced by chaff depend upon the manner in which it is used. If the bundles are dropped continuously they will cause a long line of radar returns across a radar scope. Several side by side stream drops will form a chaff corridor and an air vehicle flying within that corridor cannot be seen by certain radars using certain frequencies. These applications of chaff constitute a form of jamming.

Chaff bundles may also be dropped randomly in which case the radar scope may become filled with chaff returns so that the radar operator has difficulty finding the air vehicle. This is a deception technique similar to false target generation. Finally, chaff may be dropped in bursts of several bundles. Against tracking radar, a chaff burst will create a larger radar echo than the dropping vehicle. Thus, the radar will tend to lock on to the chaff rather than the air vehicle.

One problem that all forms of chaff have is that, once dispensed, the chaff immediately decelerates and floats to the ground while the air vehicle dispensing it continues on its flight path, leaving the protection of the chaff. Additionally, radars using Doppler gating can reject chaff due to low velocity and reacquire the air vehicle. Radar may also reacquire the air vehicle by using a moving range gate. Consequently, to defeat the more sophisticated radar defense systems air vehicles must rely on expensive active jammers, expensive stealth treatments, or very low terrain following tactics to augment the deployment of chaff.

For high end air vehicles such as fighter jets and strategic missiles, a combination of chaff, active jamming, stealth technology and low terrain guidance is a viable although sub-optimal solution. However, as radar defense systems and, in particular, terminal defense systems at the target become more sophisticated and more prevalent it is becoming apparent that low end air vehicles such as tactical missiles, drones and artillery shells must also be protected. These weapons systems cannot support the expense associated with current countermeasures. Thus, there remains an acute need for an alternative to chaff that cannot be overcome by Doppler gating and is compact, lightweight, reliable and inexpensive.

SUMMARY OF THE INVENTION

The present invention provides a compact, lightweight, reliable and inexpensive dipole-based system that is a viable alternative to chaff for overcoming sophisticated radar directed defense systems.

This is accomplished with a non-conductive filament patterned with lengths of conductive material that form dipole antennas at one or more radar frequencies. The filament is stored on the air vehicle and attached to a projectile. The filament is suitably formed of a fine nylon monofilament that is packed in a cavity in or behind the projectile. In response to a RWR warning, a programmed time or location or a time-to-target, a deployment mechanism releases the projectile(s) to deploy the filament with its dipole antennas at a speed greater than or equal to the speed of the air vehicle to present an extended target or a separate false target to enemy radar. The projectile is either towed behind or launched away from the air vehicle. Either approach is affective to overcome Doppler and moving range gating by presenting coherent signal returns and ranges and velocities consistent with the air vehicle during a threat interval posed by the radar defense systems.

A system for defeating a target's terminal defense system and destroying the target includes a missile and a seeker that provides a time to target. A filament is stored with and attached to a projectile. The filament is formed of a non-conductive carrier with lengths of conductive material that form dipole antennas at one or more radar frequencies. A mechanism launches the projectile at a predetermined time to target in front of and at a speed exceeding the missile to enter the target's terminal defense zone at a certain time before the missile and with a speed and radar cross section sufficient to prefunction the target's terminal defense system so that the missile can strike the target before it can reset its defenses.

These and other features and advantages of the invention will be apparent to those skilled in the art from the following detailed description of preferred embodiments, taken together with the accompanying drawings, in which:

DETAILED DESCRIPTION OF THE INVENTION

The present invention provides a compact, lightweight, reliable and inexpensive dipole-based system that is a viable alternative to chaff for overcoming sophisticate radar directed defense systems. Although applicable to any air vehicle the invention is particularly useful for smaller and less expensive weapons such as tactical missiles and artillery shells. The system can be used to engage and defeat radar directed weapons such as SAMs and terminal defense systems that are the final line of defense.

Figure 1:
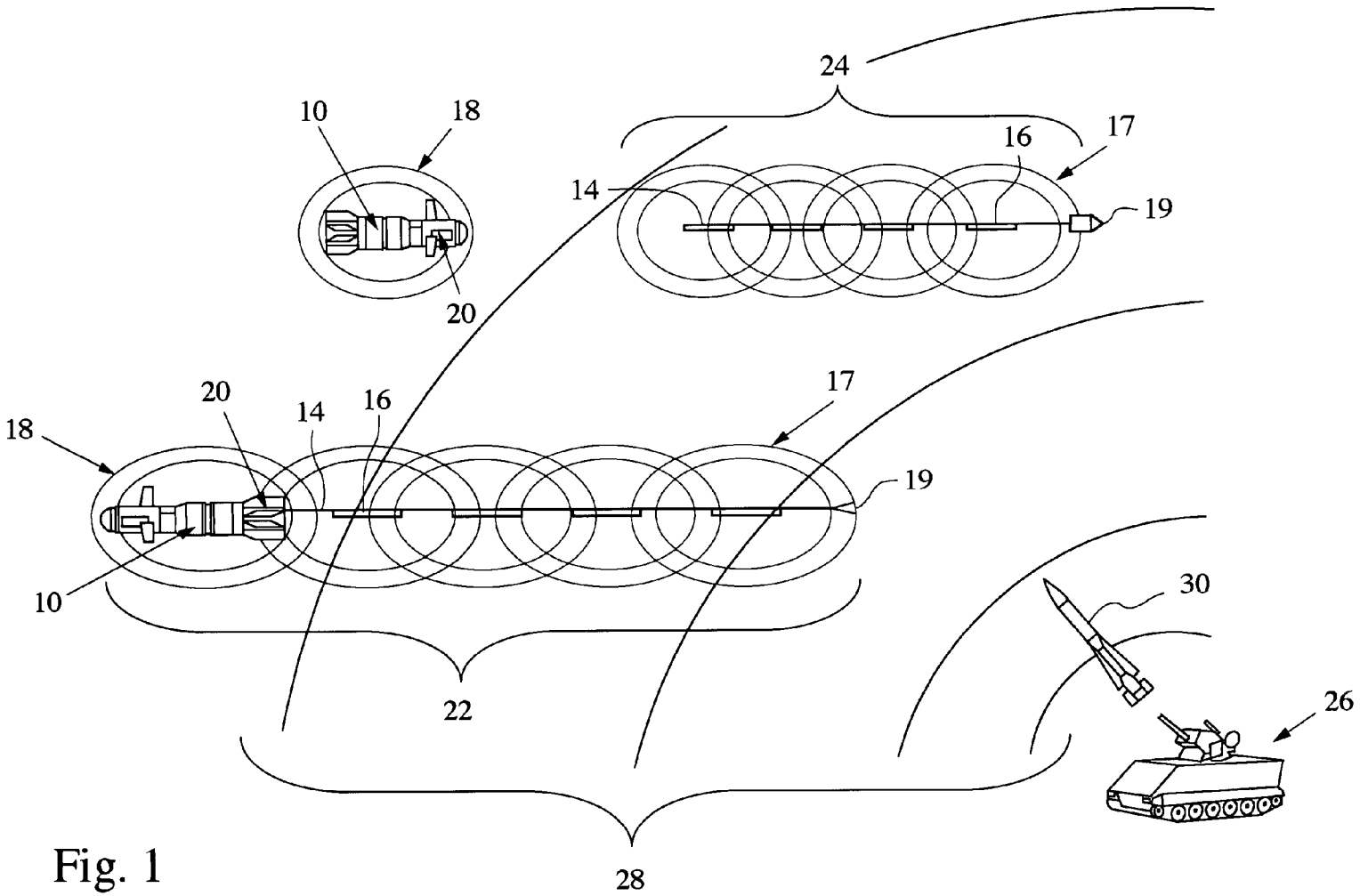
FIG. 1 is a diagram of both a towed and a launched dipole based decoy system for protecting an air vehicle against radar directed weapons in accordance with the present invention.

As shown in FIG. 1, an air vehicle 10, depicted here as a guided projectile or guided missile is provided with a dipole-based decoy system. The system includes a non-conductive filament 14 patterned with lengths of conductive material 16 that form dipole antennas at one or more radar frequencies. The dipole antennas re-radiate radar energy that impinges on the conductive material to create signatures 17 that collectively are more attractive than the air vehicle signature 18. The filament is stored on the air vehicle and attached to a projectile 19. A deployment mechanism 20 releases the projectile(s) to deploy the filament and dipole antennas speeds greater than or equal to the speed of the air vehicle. The dipole antennas present an extended target 22 or a separate false target 24 to enemy radar. As shown, the projectile can be towed behind the air vehicle or launched away from the air vehicle. In the former case, the projectile is a terminus such as a drogue, passive radar reflector or active radar reflector. In the latter case, the projectile is essentially a small bullet. Either approach is affective to overcome Doppler and moving range gating by presenting coherent signal returns and ranges and velocities consistent with the air vehicle during a threat interval posed by the radar defense systems.

In operation, a radar directed weapon such as a SAM battery 26 illuminates ("paints") the air vehicle 10 with a radar signal 28 at one or more frequencies. Radar energy that impinges on the air vehicle is re-radiated and detected by the SAM battery, which in turn identifies the target and launches a SAM 30 to intercept and destroy. The missile RWR detects radar acquisition and the SAM launch and emits a warning signal that triggers the deployment mechanism. The SAM will lock-on to the most attractive radar signature and attempt to strike the center of the target. In the case where the decoy system generates a separate false target, the SAM will lock onto the false target and detonate harmlessly. In the case where the decoy system generates an extended target, the SAM will lock-on to the centroid of the extended target and harmlessly detonate behind the missile. As will be illustrated in more detail with reference to FIG. 7, the deployment of the filament may be triggered based on a time-to-target to pre-function a terminal defense.

Figure 2A:
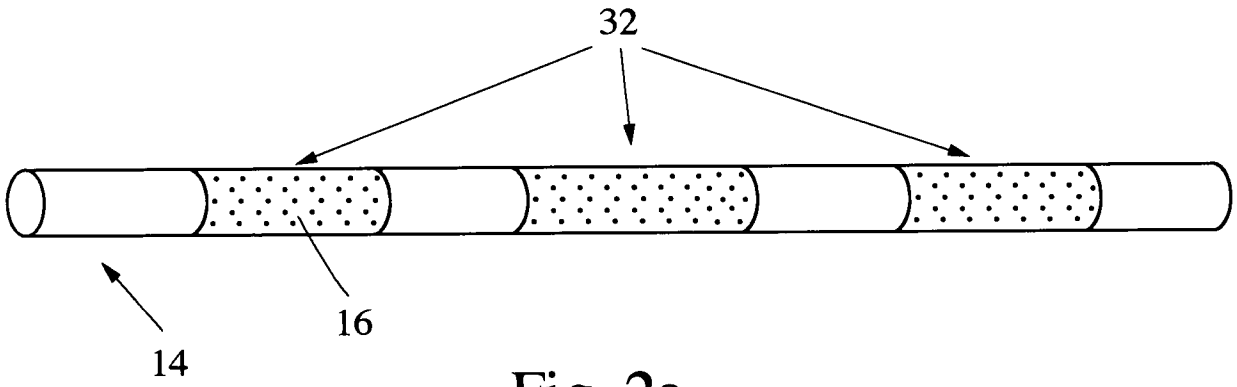
FIGS. 2*a* and 2*b* are diagrams of a non-conductive filament formed with conductive material forming dipole antennas at a single wavelength and multiple wavelengths, respectively.
Figure 2B:
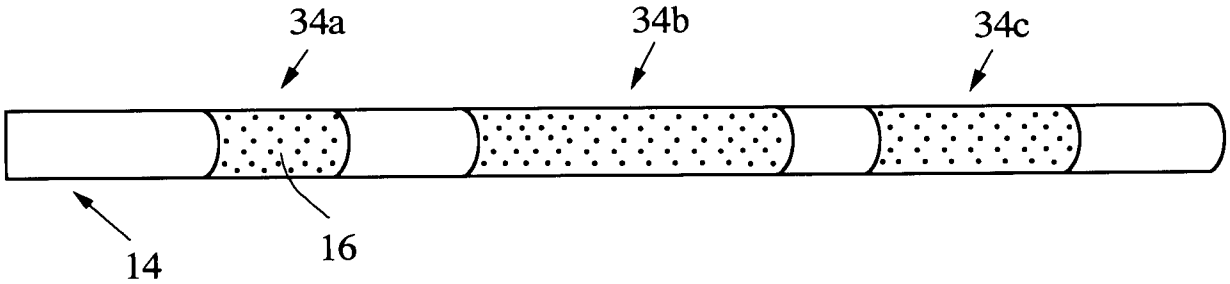

As shown in FIGS. 2*a* and 2*b*, filament 14 may be patterned with equal lengths of conductive material 16 to form dipole antennas 32 all at one frequency or with different lengths of conductive material 16 to form dipole antennas 34*a*, 34*b* and 34*c* at different frequencies. The enemy may use different frequencies, multiple frequencies or even frequency agile radar systems, in which case the air vehicle must be outfitted with a variety of dipoles. This can be done be forming multiple different dipoles on the same filament as shown. Alternately, the air vehicle may be provided with multiple decoy systems designed for different frequencies. In this case, the RWR would determine the radar frequency and deploy the appropriate filament. In certain limited situations such as on board an airplane, the filament may be provided with a contiguous conductive surface and then selectively stripped to form dipoles of the appropriate length prior to deployment.

The cross section of a small tactical air vehicle from the front quarter is around 1 sq meter (0 dBsm). The decoy cross section must be perceived at least that value. As the equation of for the normalized radar cross section of a thin cylinder approximates the projectile as well as the decoy, the desired effect would be to then deploy a filament at least 2 to 10 times the length of the projectile. The length of the filament, the number of dipole antennas, the length of the dipoles and the spacing of the dipoles is a function of the radar frequency or frequencies, air vehicle radar cross section and whether deployed to present a false target or an extended target.

Example 1

Single-Frequency Extended Target

Assuming the target radar operated at 35 GHz, the dipoles would be 8.55 mm long and separated by 17.1 mm. The thickness of the dipole is less important but is about 10-20 microns. This permits 39 diploes per meter so a 1000 dipole decoy requires 25 meters, weight about 10 grams and requiring a volume of about 120 $cm^3$ to package. Packed with a drogue and gas generator, the package would have a mass around 100 grams and a volume would be around 130 $cm^3$ Example 2

Multiple-Frequency False Target

Assuming the threat system operated at 35 GHz and 90 GHz, the dipoles would be 8.55 mm long and separated by 17.1 mm. In the separation length there would be 2 dipoles each 3.3 mm and a separation of 6.7 mm. The thickness of the dipole is less important but is about 10-20 microns. This permits 39 diploes per meter so a 500 dipole decoy requires 12.8 meters, weight about 4 grams and requiring a volume of about 60 $cm^3$ to package. Packed with a drogue and gas generator, the package would have a mass around 100 grams and a volume would be around 65 $cm^3$ Example 3

Single-Frequency False Target (Launched)

Assuming the target radar operated at 35 GHz, the dipoles would be 8.55 mm long and separated by 17.1 mm. The thickness of the dipole is less important but is about 10-20 microns. This permits 39 diploes per meter so a 500 dipole decoy requires 12.8 meters, weight about 4 grams and requiring a volume of about 60 $cm^3$ to package. Packaged with a deployment mass to pull the filament at 100 fps faster than the missile and gas generator, the package would have a mass around 120 grams and a volume would be around 85 $cm^3$.

Figure 3:
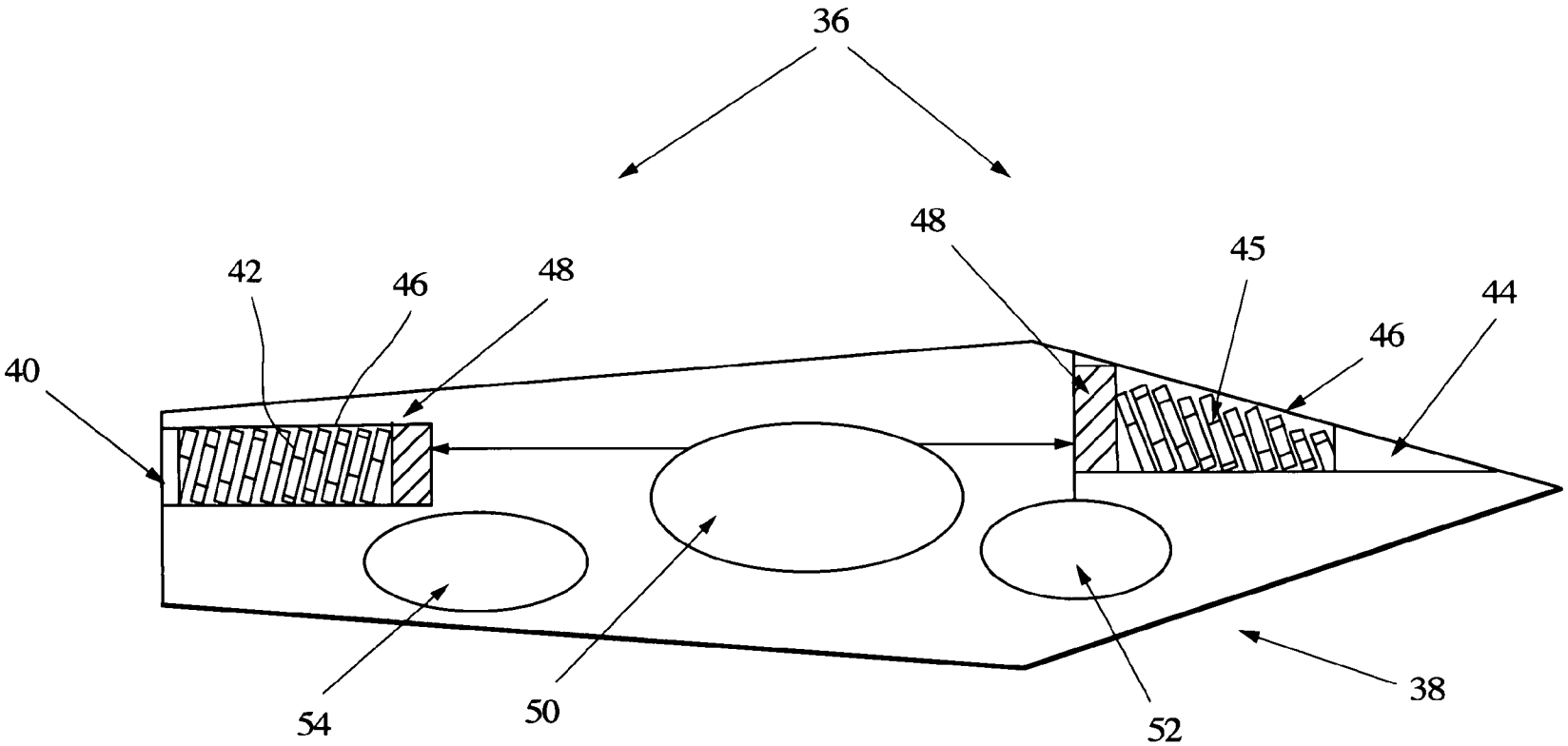
FIG. 3 is a diagram of a deployment mechanism for a dipole based decoy system.

FIG. 3 illustrates an embodiment of a dipole-based decoy system 36 for use with a missile 38. This system is configured to both tow a drogue 40 (small aero-drag device used to keep the line taut) and filament 42 behind the missile and to launch a bullet 44 and filament 45 ahead of the missile. In both cases, the deployment mechanism suitably includes a simple launch tube 46 and a gas generator 48. The filament is packed in the launch tube behind the drogue or bullet, which are passive projectiles (no self-propulsion). The filament is suitably a mono-filament made of glass, plastic or nylon. Alternately, the filament could be a Mylar tape with randomly oriented dipoles. This assembly is compact, lightweight, reliable and inexpensive. As shown, the launch tubes have been integrated into the missile design. Alternately, they could be designed as a strap-on system to retrofit existing missiles.

In the case where the drogue is towed behind the missile, the aft firing gas generator 48 merely pops the drogue 40 and filament 42 out and the drag provides the force necessary to unreel the filament. A small gas generator is adequate for this purpose. The total volume of the assembly in the launch tube is typically no more than 65 $cm^3$ with a total weight of less than 20 grams. Even in the worst case where the dipole antennas are towed 100 ft or more behind the missile to create a false target, the packaged filament occupies less than 200 $cm^3$, which is considerably smaller than a chaff package In the case where the bullet is fired in front of the missile, the starboard firing gas generator must accelerate the projectile into the wind to a speed faster than that of the missile. The inertia generated by the acceleration of the bullet causes the filament to be deployed behind the projectile. The bullet is suitably a small caliber for example, 32 caliber or less. A larger gas generator is needed to accomplish this. The total volume of the assembly in the launch tube is typically no more than 85 $cm^3$ with a total weight of less than 140 grams.

The decoy system also interfaces with and utilizes standard components of the missile including a flight computer 50, seeker 52 and RWR 54. The RWR provides a warning signal when the missile is being painted by an enemy radar defense. The seeker provides time-to-target information. The flight computer can use either signal to trigger the deployment mechanism to release the drogue/bullet and filament.

Figure 4:
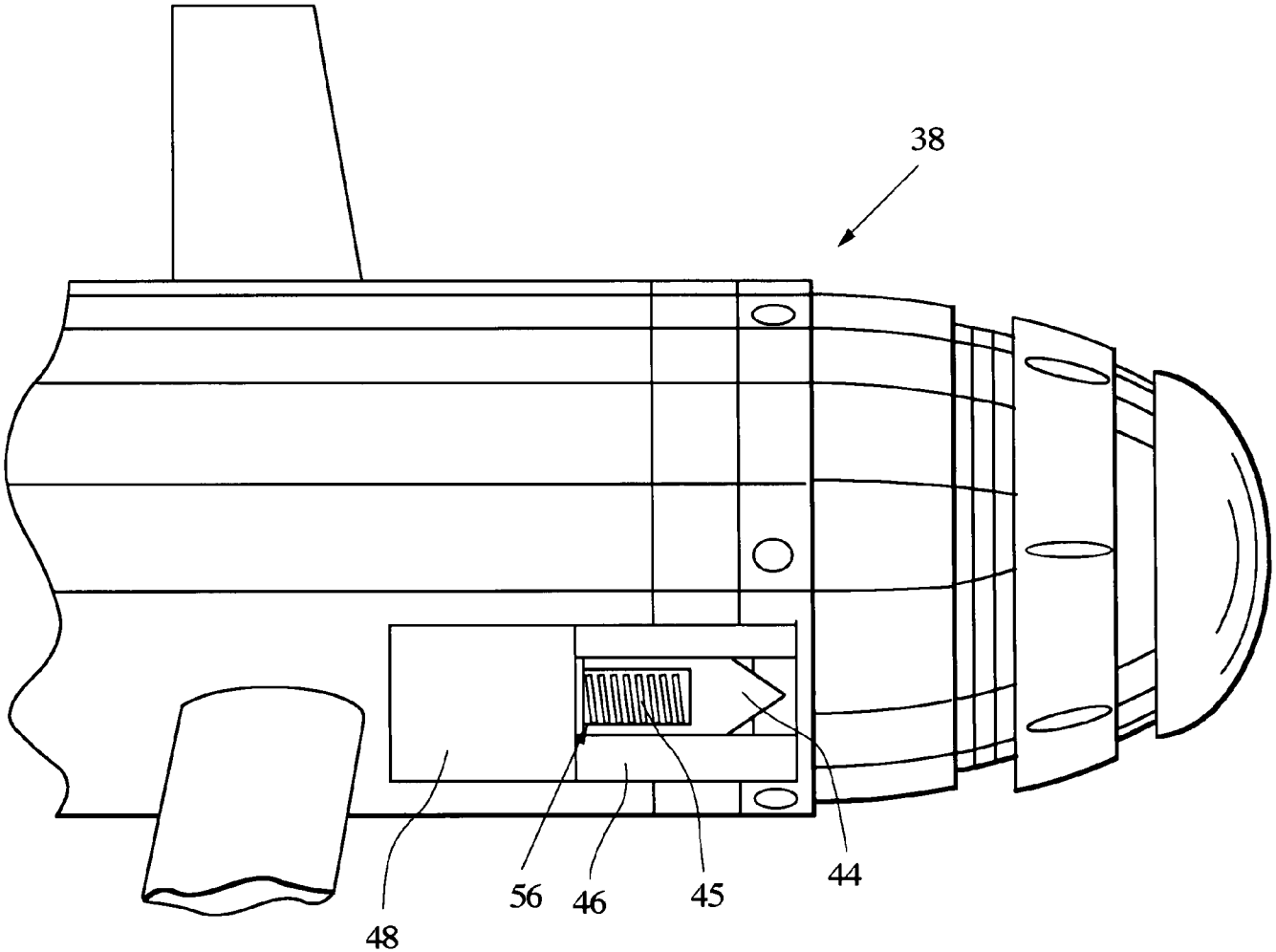
FIG. 4 is a diagram of an alternate deployment mechanism for a dipole based decoy system.

As shown in FIG. 4, the filament 14 is packed in a cavity 56 in the bullet 44. Whether the filament unreels from inside the expelled bullet or from within the missile's launch tube is of no practical concern. However, it may be easier, cheaper and more compact to package the filament inside the bullet (or drogue).

Figure 5:
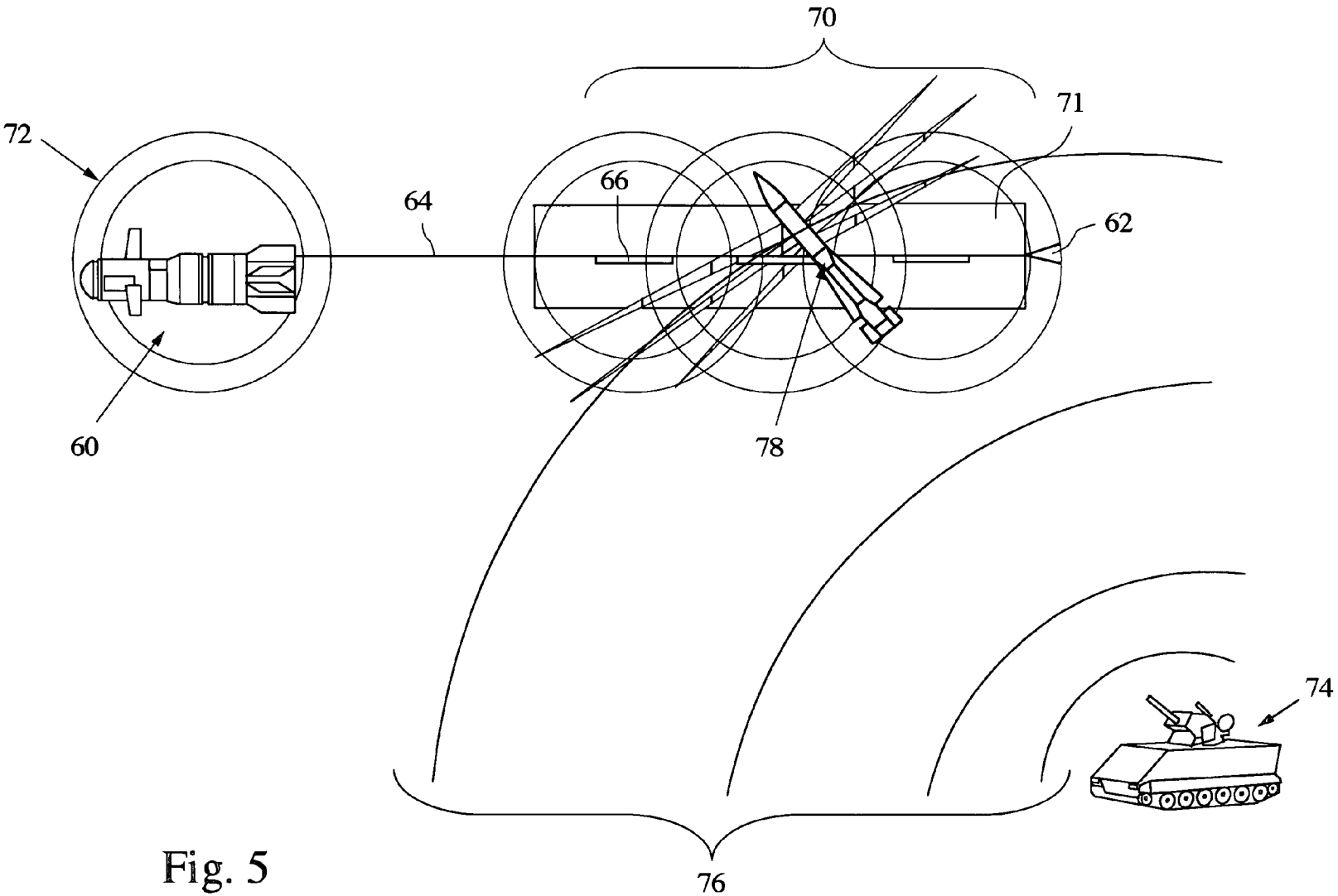
FIG. 5 is a diagram of the towed system deployed to create a false target.

As shown in FIG. 5, a missile 60 has deployed a drogue 62 and filament 64 in a towed configuration. The end of the filament (towards the drogue) is patterned with lengths of conductive material 66 that form dipole antennas at one or more radar frequencies. The dipole antennas are separated from the missile by a sufficient distance that their collective signatures 70 present a false target 71 that is more attractive to enemy radar defenses than the missile's signature 72. The separation will typically be 0 to 100 feet depending upon the type of missile (air vehicle). As a result, when a SAM missile 74 battery paints the target with a radar signal 76 and launches a SAM 78, the SAM will lock-on and destroy the false target 71. Alternately, the projectile and filament can be launched away from the missile to create the false target.

Figure 6:
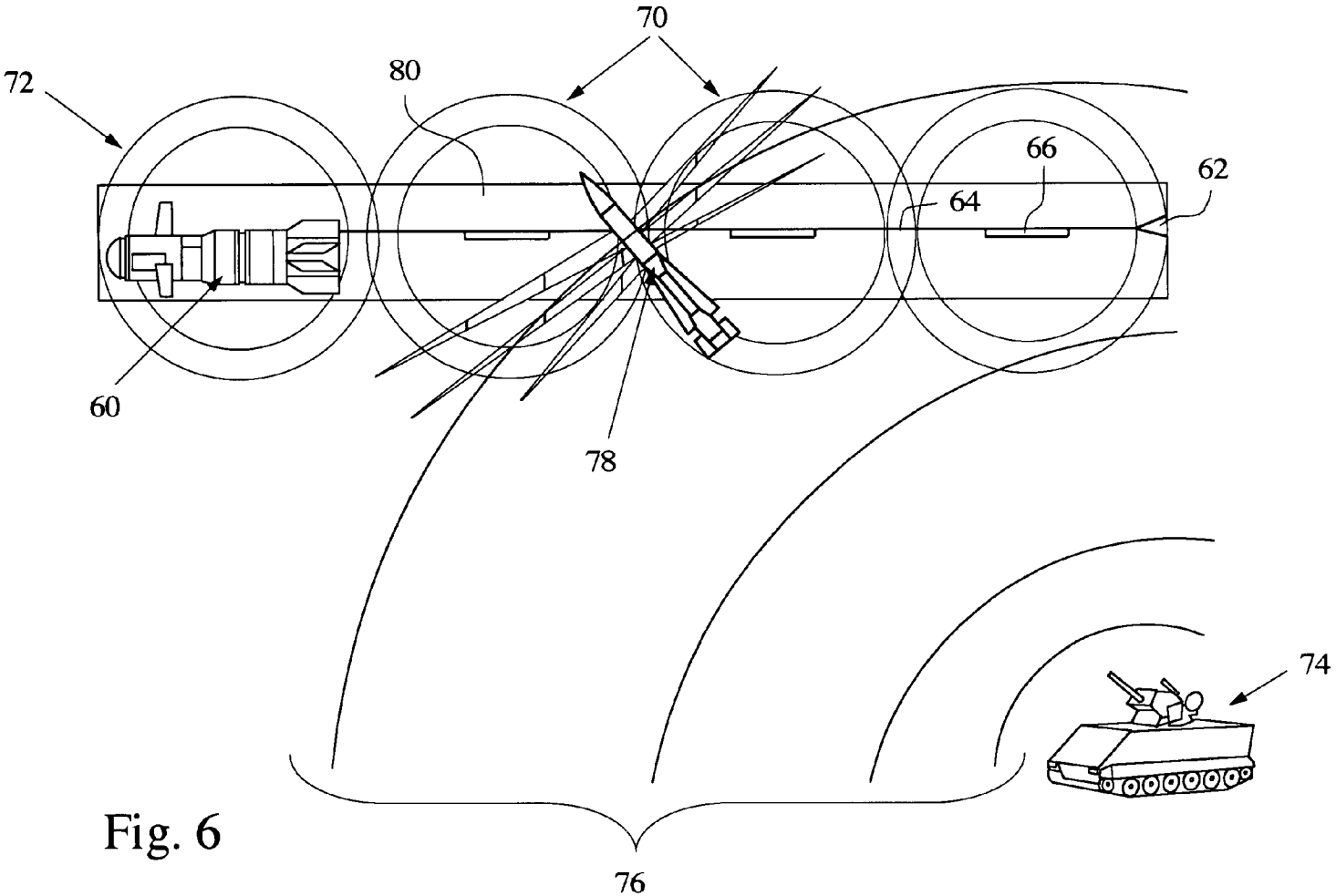
FIG. 6 is a diagram of the towed system deployed to create an extended target.

As shown in FIG. 6, a missile 60 has deployed a drogue 62 and filament 64 in a towed configuration. The filament is patterned with lengths of conductive material 66 that form dipole antennas at one or more radar frequencies. The dipole antennas are in close proximity to the missile so that their signatures 70 together with the missile's signature 72 create an extended target 80 whose center is well behind the actual missile. As a result, when a SAM missile 74 battery paints the target with a radar signal 76 and launches a SAM 78, the SAM will lock-on and destroy the center of the extended target 80 thus missing the missile.

Figure 7:
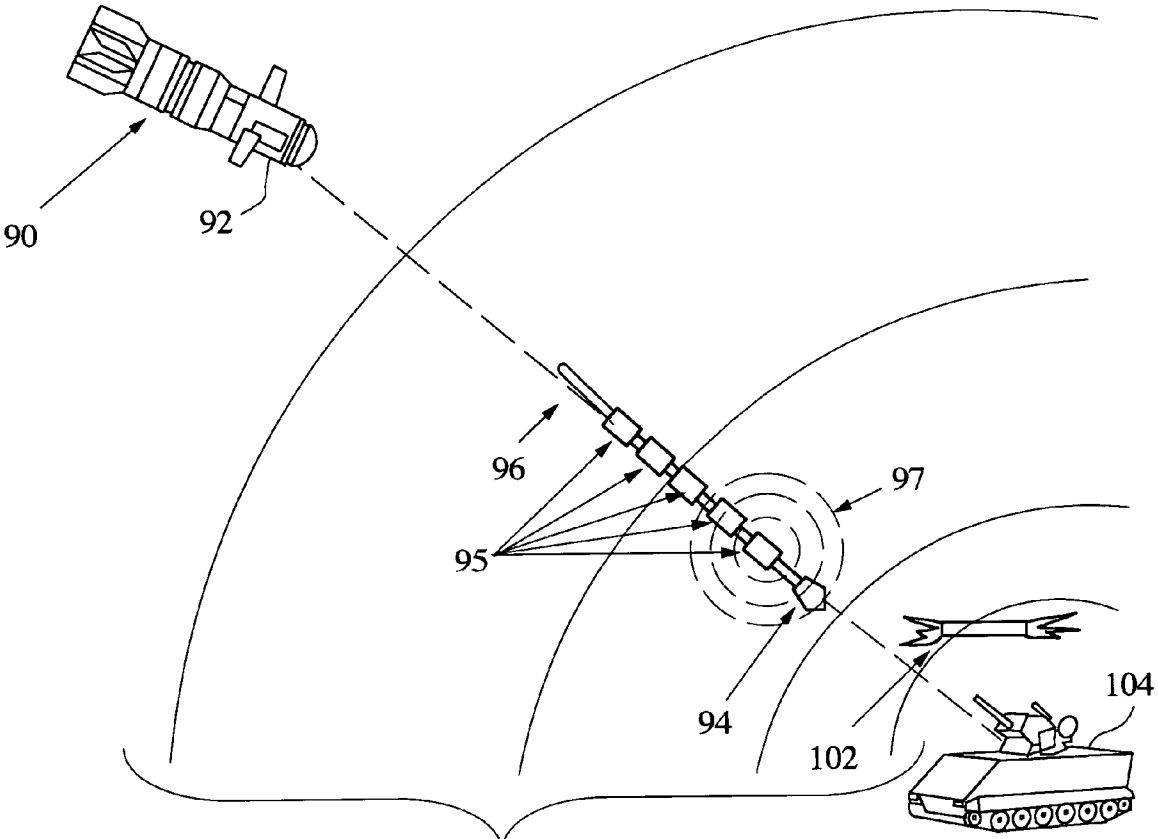
FIG. 7 is a diagram of a launched system deployed at a time to target to prefunction a terminal defense system.

In addition to being effective to defeat conventional radar based defense systems, e.g. SAM batteries, the dipole based decoy system and particularly the projectile launched configuration are effective to prefunction and thus defeat radar based terminal defenses of the type shown in FIG. 7. A seeker on board the missile 90 provides the time-to-target. At a predetermined time to target, e.g. 1.5 seconds, the flight computer triggers the deployment mechanism 92 to launch the projectile 94 in front of and at a speed exceeding the missile to enter the target's terminal defense zone at a certain time before the missile, e.g. 0.5 second. The speed of and radar cross section formed by the dipole antennas 95 on the filament 96 are selected to present an attractive false target 97 to the radar signal 98 that prefunctions the target's terminal defense system causing it to launch, for example, grenades 102, which explode harmlessly in front of the missile. The short interval between the presentation of the false target and the missile is insufficient for the terminal defense to reset. As a result, the missile penetrates the defense and strikes the target 104.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A dipole based decoy system for protecting an air vehicle against radar directed weapons, comprising:

a projectile;

a stored non-conductive filament patterned with lengths of conductive material that form dipole antennas, said filament being attached to the projectile;

a mechanism for releasing the projectile to deploy the filament with its dipole antennas at a speed greater than or equal to the speed of the air vehicle; and a seeker that provides a time to target, said mechanism releasing the projectile at a predetermined time to target.

2. The dipole base decoy system of claim 1, wherein said projectile is passive.

3. The dipole base decoy system of claim 1, wherein said filament comprises a non conductive monofilament.

4. The dipole base decoy system of claim 1, wherein the conductive material is of varying lengths to form multiple dipole antennas at different wavelengths.

5. The dipole base decoy system of claim 1, wherein the mechanism, projectile and stored filament together weighs less than 100 grams and occupy a volume less that 100 $cm^3$.

6. The dipole base decoy system of claim 1, wherein the filament is stored inside the projectile.

7. The dipole base decoy system of claim 1, further comprising a radar warning receiver (RWR), said mechanism releasing the projectile in response to a warning signal generated by the RWR.

8. The dipole base decoy system of claim 1, wherein the projectile is a terminus that is towed behind the air vehicle.

9. The dipole base decoy system of claim 8, wherein the dipole antennas present a radar signature at least equal to the air vehicle and separated from the air vehicle by a sufficient distance to present a false target.

10. The dipole base decoy system of claim 9, wherein the dipole antennas are separated from the air vehicle by at least 100 feet.

11. The dipole base decoy system of claim 8, wherein the dipole antennas are towed in close proximity to the air vehicle to extend its radar signature so that the center of the radar signature is spaced away from the air vehicle.

12. The dipole base decoy system of claim 11, wherein the number of dipole antennas are sufficient to move the center of the radar signature at least 100 feet away from the air vehicle.

13. The dipole base decoy system of claim 8, wherein the terminus comprises a passive radar reflector or active radar source.

14. The dipole base decoy system of claim 8, wherein the mechanism comprises a launch tube and an ejector that pops the projectile out of the launch tube to release the terminus.

15. The dipole base decoy system of claim 1, wherein the mechanism launches the projectile away from the air vehicle to present a false target.

16. The dipole base decoy system of claim 15, wherein the mechanism comprises a launch tube and an ejector that accelerates the projectile through the launch tube and away from the air vehicle, the inertia generated by said acceleration causing the filament to be deployed behind the projectile.

17. The dipole base decoy system of claim 16, wherein the projectile includes a cavity in which the filament is stored.

18. The dipole base decoy system of claim 16, wherein the ejector comprises a gas cartridge.

19. A dipole based decoy system for protecting an air vehicle against radar directed weapons, comprising:

a projectile;

a stored non-conductive filament patterned with lengths of conductive material that form dipole antennas, said filament being attached to the projectile; and a mechanism for releasing the projectile to deploy the filament with its dipole antennas at a speed greater than or equal to the speed of the air vehicle wherein the mechanism launches the projectile away from the air vehicle to resent a false target and wherein the projectile is launched in front of and at a speed exceeding the air vehicle to enter a target's terminal defense zone at a certain time before the air vehicle and with a speed and a radar cross section to prefunction the target's defense mechanism so that the air vehicle can strike the target before it can reset its defenses.

20. The dipole base decoy system of claim 19, wherein the dipole antennas present a radar signature at least equal to the air vehicle and are separated from the air vehicle by a sufficient distance to present a false target.

21. The dipole base decoy system of claim 19, wherein the dipole antennas are separated from the air vehicle by at least 100 feet.

22. The dipole base decoy system of claim 19, wherein the dipole antennas are in close proximity to the air vehicle to extend a radar signature so that the center of the radar signature is spaced away from the air vehicle.

23. The dipole base decoy system of claim 22, wherein the number of dipole antennas are sufficient to move the center of the radar signature at least 100 feet away from the air vehicle.

24. The dipole base decoy system of claim 19, wherein the terminus comprises a passive radar reflector or active radar source.

25. The dipole base decoy system of claim 19, wherein the mechanism comprises a gas generator to release the terminus.

26. A dipole based decoy system comprising:

an air vehicle;

a projectile having a cavity;

a filament stored in the cavity and attached to the projectile, said filament formed of a non-conductive carrier with lengths of conductive material that form dipole antennas;

a mechanism for launching the projectile away from the air vehicle at a speed greater than or equal to the speed of the air vehicle to deploy the filament with its dipole antennas and create a false start; and a seeker that provides a time to target, said mechanism launching the projectile at a predetermined time to target in front of and at a speed exceeding the air vehicle to enter the target's terminal defense zone at a certain time before the air vehicle and with a speed and radar cross section to prefunction the target's defense mechanism so that the air vehicle can strike the target before it can reset its defenses.

27. The dipole base decoy system of claim 26, wherein the mechanism comprises a launch tube and an ejector that accelerates the projectile through the launch tube and away from the air vehicle, the inertia generated by said acceleration causing the filament to be deployed behind the projectile.

28. The dipole base decoy system of claim 27, wherein the ejector comprises a gas cartridge.

29. A system defeating a target's terminal defense system and destroying the target, comprising:

a missile;

a seeker that provides time to target;

a projectile;

a filament stored with the attached projectile, said filament formed of a non-conductive carrier with lengths of conductive material that form dipole antennas; and a mechanism for launching the projectile at a predetermined time to target in front of and at a speed exceeding the missile to enter the target's terminal defense zone at a certain time before the missile and with a speed and radar cross section to prefunction the target's terminal defense system so that the missile can strike the target before it can reset its defenses.

* * * * *